United States Patent [19]

Doane et al.

[11] 4,367,810

[45] Jan. 11, 1983

[54] ELEVATOR CAR AND DOOR MOTION INTERLOCKS

[75] Inventors: John C. Doane, Glastonbury, Conn.; J. Mark Deric, Johnson City, Tenn.; Gary K. Roberts, Enfield, Conn.

[73] Assignee: Otis Elevator Company, Farmington, Conn.

[21] Appl. No.: 107,691

[22] Filed: Dec. 27, 1979

[51] Int. Cl.[3] ..... B66B 5/02

[52] U.S. Cl. ..... 187/29 R

[58] Field of Search ..... 187/29

[56] References Cited

U.S. PATENT DOCUMENTS

| | | | |
|---|---|---|---|
| 3,587,785 | 6/1971 | Krauer et al. | 187/29 |
| 3,961,688 | 6/1976 | Maynard | 187/29 |
| 4,193,478 | 3/1980 | Keller et al. | 187/29 |

*Primary Examiner*—J. V. Truhe
*Assistant Examiner*—W. E. Duncanson, Jr.
*Attorney, Agent, or Firm*—M. P. Williams

[57] ABSTRACT

An elevator includes a microprocessor-based cab controller mounted on the elevator car to monitor calls for service by passengers in the car, controls the opening and closing of the door, monitors the position of the car relative to an adjacent landing and communicates with a microprocessor-based car controller, disposed at the top of the shaftway, which controls the motion of the car in the shaftway and provides commands to the cab controller, such as door opening and closing demands relating to calls at the landings, and the like. The cab controller monitors the viability of communications which it receives from the car controller, monitors the position of the door relative to the position of the car with respect to floor landings and provides a signal to enable applying power to the sheave-driving motor and the brake pick-up coils in the machine room only in the event that such monitoring indicates no safety problems. Similarly, the cab controller monitors the elevator door and all of the hoistway doors, and in dependence upon the position of the elevator with respect to a floor landing and the speed of the elevator, determines unsafe conditions and directly opens the power circuit to the door motor. An exemplary elevator system, including an exemplary microprocessor-based cab controller, a general door control program flowchart, illustrative of a system in which the present invention may be practiced, and detailed apparatus and flowcharts for practicing the present invention are all disclosed.

4 Claims, 11 Drawing Figures

MAINT DR MOTR CUR
29
I DICT
23
22
AMP/SCRs
ACTIVATE DR MOTR
RELAY
24
27
28
NOT OP INH DR
25
I FB
31
26
21 TRANS
19
18
INTFC
16
14
13
20 DR CLSNG
12
9
8
10
7 CAB/ARM
PIVOT
11
6
6
4
3
2
5
LINK/DOOR
PIVOT
3
2
5 ARM/LINK
PIVOT
4
DOOR-OPENED
DOOR-CLOSED
1 (OPEN)
1 (CLOSED)
EDGE OF OPENING

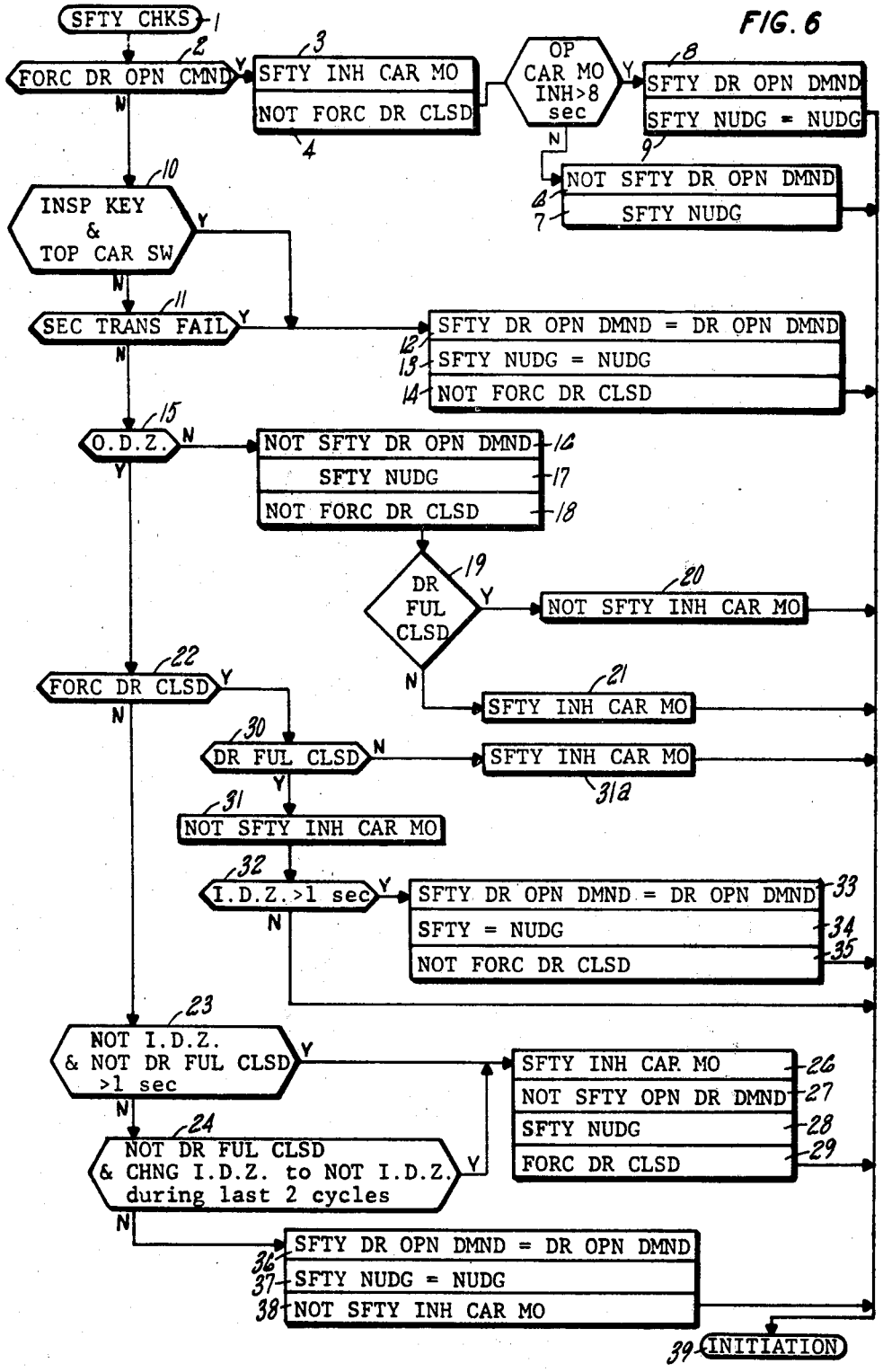
FIG. 6
SFTY CHKS
1
FORC DR OPN CMND
2
SFTY INH CAR MO
NOT FORC DR CLSD
3
4
OP CAR MO INH>8 sec
SFTY DR OPN DMND
SFTY NUDG = NUDG
8
9
NOT SFTY DR OPN DMND
SFTY NUDG
6
7
INSP KEY & TOP CAR SW
10
SEC TRANS FAIL
11
SFTY DR OPN DMND = DR OPN DMND
SFTY NUDG = NUDG
NOT FORC DR CLSD
12
13
14
O.D.Z.
15
NOT SFTY DR OPN DMND
SFTY NUDG
NOT FORC DR CLSD
16
17
18
DR FUL CLSD
19
NOT SFTY INH CAR MO
20
SFTY INH CAR MO
21
FORC DR CLSD
22
DR FUL CLSD
30
SFTY INH CAR MO
31a
NOT SFTY INH CAR MO
31
I.D.Z.>1 sec
32
SFTY DR OPN DMND = DR OPN DMND
SFTY = NUDG
NOT FORC DR CLSD
33
34
35
NOT I.D.Z. & NOT DR FUL CLSD >1 sec
23
SFTY INH CAR MO
NOT SFTY OPN DR DMND
SFTY NUDG
FORC DR CLSD
26
27
28
29
NOT DR FUL CLSD & CHNG I.D.Z. to NOT I.D.Z. during last 2 cycles
24
SFTY DR OPN DMND = DR OPN DMND
SFTY NUDG = NUDG
NOT SFTY INH CAR MO
36
37
38
INITIATION
39
Y
N

ELEVATOR CAR AND DOOR MOTION INTERLOCKS

TECHNICAL FIELD

This invention relates to elevators, and more particularly to provision of a car motion inhibit controlled by a cab controller mounted on the car together with a car door motion inhibit provided by a car controller disposed remotely from and connected with the car.

BACKGROUND ART

In elevators known to the art, the elevator car, traveling up and down in a hoistway, is controlled by a car controller, typically located in a machine room at the head of the hoistway, along with the sheave, motor and brake which control the motion of the car. In most elevators known to the art, the car is literally a slave to the car controller, the car controller telling the car when to open and close its doors, and otherwise performing essentially all the functions necessary to raise and lower the car into position accurately at landings. Even in the case of apparatus mounted on the car itself, the apparatus is simply directly wired through the traveling cable to the car controller, and the analysis of conditions represented by the signals in the wires is performed by the car controller.

In the case of conditions relating to the car which are sensed or created at the car itself, a safer degree of operation would result if the car were able to analyze such conditions, and contribute in the control of the functioning of the car as a consequence of conditions, particular those that relate to passenger safety.

In systems known to the art, the car controller would not only control the functions performed within the car itself, but would receive signals which it would then analyze to determine whether the car response ultimately seemed to be proper or not. For instance, only the car controller was cognizant of such dangerous conditions as the elevator door not being fully closed when the elevator was located away from the landing or when the car was traveling at excessive speed. And the response of the car controller to any such condition simply had to be the sending of a command to the car, whether it could be acted on or not, to try and correct the condition (such as a force doors closed command). Or, the car controller could arrest the motion of the car if it determined such a case to be warranted.

DISCLOSURE OF INVENTION

Objects of the invention include improved safety in the operation of elevators, particularly concerning the relationship between a car and a car controller disposed remotely therefrom and connected thereto.

According to the present invention, elevator car functions which are apparent within the elevator car are checked and malfunctions therein are caused to inhibit motion of the car by direct interlock with the car motion means, and functions performed by and apparent to a car controller are analyzed for malfunction to cause inhibiting of door motion by a direct interlock with the door motion means. In further accord with the present invention, functions such as failure of the car controller and a cab controller mounted directly on the car to properly exchange signals with each other as determined by the cab controller, and car doors being open when the car is not within a proper distance of a floor landing are monitored, and the occurrence thereof directly deactivates relay means that remove power from the car motion apparatus located in the machine room, such as the motor field and brake pick-up coils, thereby ensuring that motion of the car will be arrested. In further accord with the invention, functions apparent in the car controller, such as an indication by it that the elevator door or any hoistway door is not fully closed, when the indications are that the car is not within the desired distance of the landing or traveling at a proper speed with respect to the distance of the car from a landing, will cause opening of a relay means in series with the door operating motor, to inhibit any operation of the door.

The present invention provides direct, cross interlocking between the elevator car itself and the apparatus in the machine room which controls the elevator car. The invention gives apparatus disposed on the car itself the capability of inhibiting car motion, while at the same time, conditions in the car controller in the machine room have the ability of inhibiting door motion.

The invention provides an improved degree of safety in that the safety functions do not rely solely on the checks made thereof in the car controller, but also allow additional safety checks to be made in the cab controller. The invention also provides additional safety in that the action to be taken by malfunctions detected in the cab controller need not be performed by the car controller, but is performed directly in response to the cab controller (inhibiting car motion by forcing an arresting of the motion). And, safety is further enhanced by the lack of any need on the part of either the cab controller or the car controller to analyze signals indicative of failures found by the other controller before acting thereon.

The present invention may be implemented in a variety of ways, and in elevator systems of a variety of types. The invention may be implemented utilizing apparatus and techniques which are well within the skill of the art in the light of the specific teachings of the present invention which are described hereinafter.

The foregoing and other objects, features and advantages of the present invention will become more apparent in the light of the following detailed description of an exemplary embodiment thereof, as illustrated in the accompanying drawings.

BRIEF DESCRIPTION OF DRAWINGS

FIG. 6 is a logic flowchart of a safety checks subroutine;

BEST MODE FOR CARRYING OUT THE INVENTION

Figure 1:
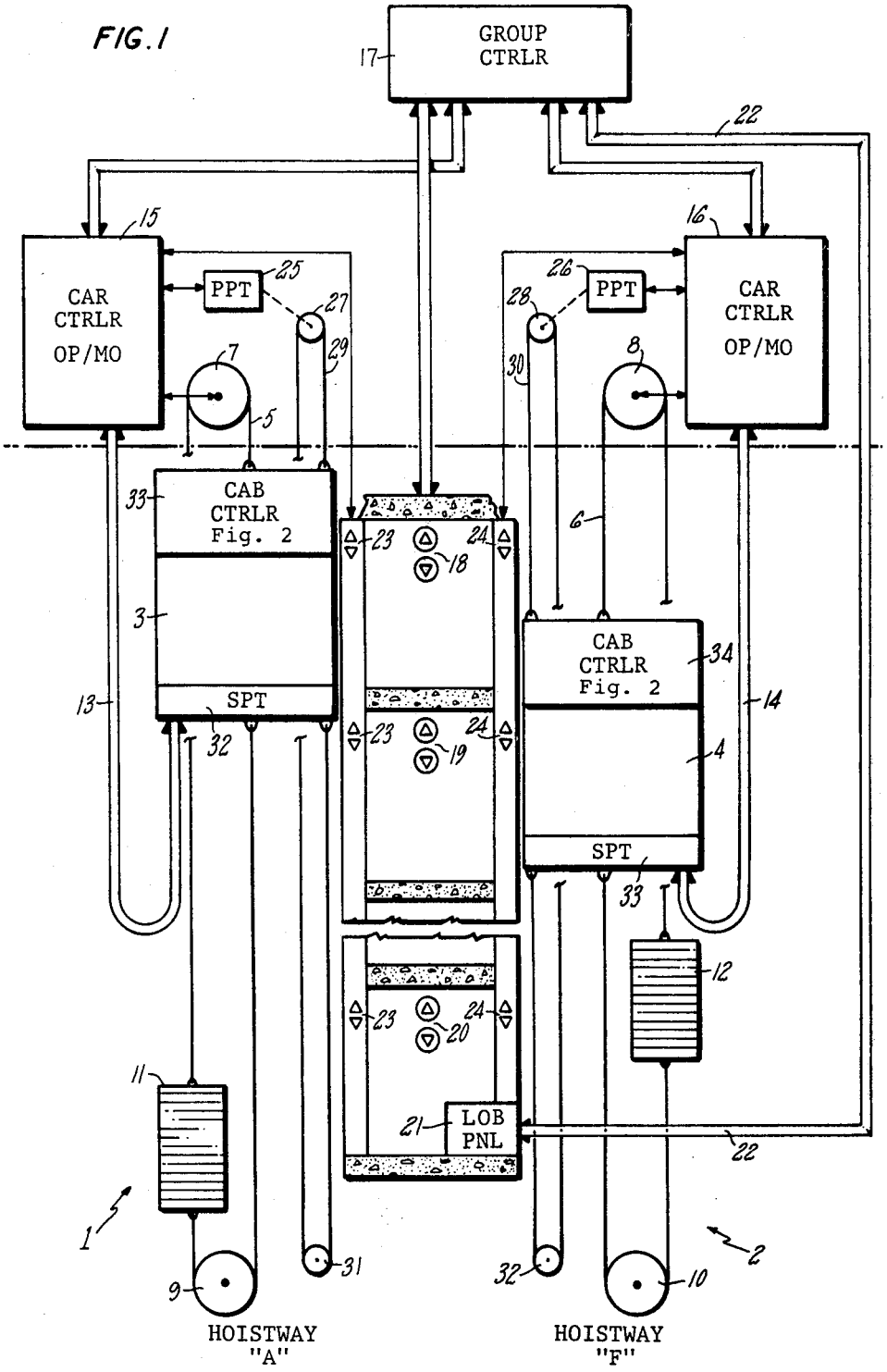
FIG. 1 is a simplified, schematicized view of an elevator system in which the present invention may be practiced.

A simplified description of a multi-car elevator system, of the type in which the present invention may be practiced, is illustrated in FIG. 1. Therein, a plurality of hoistways, HOISTWAY "A" 1 and HOISTWAY "F" 2 are illustrated, the remainder are not shown for simplicity. In each hoistway, an elevator car or cab 3, 4 is guided for vertical movement on rails (not shown). Each car is suspended on a rope 5, 6 which usually comprises a plurality of steel cables, that is driven either direction or held in a fixed position by a drive sheave/-motor/brake assembly 7, 8, and guided by an idler or return sheave 9, 10 in the well of the hoistway. The rope 5, 6 normally also carries a counterweight 11, 12 which is typically equal to approximately the weight of the cab when it is carrying half of its permissable load.

Each cab 3, 4 is connected by a traveling cable 13, 14 to a corresponding car controller 15, 16 which is located in a machine room at the head of the hoistways. The car controllers 15, 16 provide operation and motion control to the cabs, as is known in the art. In the case of multi-car elevator systems, it has long been common to provide a group controller 17 which receives up and down hall calls registered on hall call buttons 18-20 on the floors of the buildings, allocates those calls to the various cars for response, and distributes cars among the floors of the building, in accordance with any one of several various modes of group operation. Modes of group operation may be controlled in part by a lobby panel 21 which is normally connected by suitable building wiring 22 to the group controller in multi-car elevator systems.

The car controllers 15, 16 also control certain hoistway functions which relate to the corresponding car, such as the lighting of up and down response lanterns 23, 24, there being one such set of lanterns 23 assigned to each car 3, and similar sets of lanterns 24 for each other car 4, designating the hoistway door where service in response to a hall call will be provided for the respective up and down directions.

The foregoing is a description of an elevator system in general, and, as far as the description goes thus far, is equally descriptive of elevator systems known to the prior art, and elevator systems incorporating the teachings of the present invention.

Although not required in the practice of the present invention, the elevator system in which the invention is utilized may derive the position of the car within the hoistway by means of a primary position transducer (PPT) 25, 26 which may comprise a quasiabsolute, incremental encoder and counting and directional interface circuitry of the type described in a commonly owned copending U.S. patent application of Marvin Masel et al, Ser. No. 927,242, filed on July 21, 1978, (a continuation of Ser. No. 641,798, filed Dec. 18, 1975), entitled HIGH RESOLUTION AND WIDE RANGE SHAFT POSITION TRANSDUCER SYSTEMS. Such transducer is driven by a suitable sprocket 27, 28 in response to a steel tape 29, 30 which is connected at both its ends to the cab and passes over an idler sprocket 31, 32 in the hoistway well. Similarly, although not required in an elevator system to practice the present invention, detailed positional information at each floor, for more door control and for verification of floor position information derived by the PPT 25, 26, may employ a secondary position transducer (SPT) 32, 33 of the type disclosed and claimed in a commonly owned copending U.S. application field on Nov. 13, 1979 by Fairbrother, Ser. No. 093,475. Or, if desired, the elevator system in which the present invention is practiced may employ inner door zone and outer door hoistway-autuated zone switches of the type known in the art.

The foregoing description of FIG. 1 is intended to be very general in nature, and to encompass, although not shown, other system aspects such as shaftway safety switches and the like, which have not been shown herein for simplicity, since they are known in the art and not a part of the invention herein.

All of the functions of the cab itself are directed, or communicated with, by means of a cab controller 33, 34 in accordance with the present invention, and may provide serial, time-multiplexed communications with the car controller as well as direct, hard-wired communications with the car controller by means of the traveling cables 13, 14. The cab controller, for instance, will monitor the car call buttons, door open and door close buttons, and other buttons and switches within the car; it will control the lighting of buttons to indicate car calls, and will provide control over the floor indicator inside the car which designates the approaching floor. The cab controller interfaces with load weighing transducers to provide weight information used in controlling the motion, operation, and door functions of the car. The load weighing may be in accordance with the invention described and claimed in commonly owned copending patent applications filed on Nov. 27, 1979 by Donofrio, Ser. No. 98004, now U.S. Pat. No. 4,330,836 and by Games, Ser. No. 98003, now abandoned. A most sigificant job of the cab controller 33, 34 is to control the opening and closing of the door, in accordance with demands therefore under conditions which are determined to be safe.

The makeup of microcomputer systems, such as may be used in the implementation of the car controllers 15, 16, a group controller 17, and the cab controllers 33, 34, can be selected readily available components or families thereof, in accordance with known technology as described in various commercial and technical publications. These include "An Introduction to Microcomputers, Volume II, Some Real Products" published in 1977 by Adam Osborne and Associates, Inc., Berkeley, Calif., U.S.A., and available from Sydex, Paris, France; Arrow International, Tokyo, Japan, L. A. Varah Ltd., Vancouver, Canada, and Taiwan Foreign Language Book Publishers Council, Taipei, Taiwan. And, "Digital Microcomputer Handbook", 1977–1978 Second Edition, published by Digital Equipment Corporation, Maynard, Mass., U.S.A. And, Simpson, W. D., Luecke, G., Cannon, D. L., and Clemens, D. H., "9900 Family Systems Design and Data Book", 1978, published by Texas Instruments, Inc., Houston, Tex., U.S.A. (U.S. Library of Congress Catalog No. 78-058005). Similarly, the manner of structuring the software for operation of such computers may take a variety of known forms, employing known principles which are set forth in a variety of publications. One basic fundamental treatise is "The Art of Computer Programming", in seven volumes, by the Addison-Wesley Publishing Company, Inc., Reading, Mass., and Menlo Park, Calif., U.S.A.; London, England; and Don Mills, Ontario, Canada (U.S. Library of Congress Catalog No. 67-26020). A more popular topical publication is "EDN Microprocessor Design Series" published in 1975 by Kahners Publishing Company (Electronic Division News), Boston, Mass., U.S.A. And a useful work is Peatman, J. B., "Microcomputer-Based Design" published in 1977 by McGraw Hill Book Company (worldwide), U.S. Library of Congress Catalog No. 76-29345.

The software structures for implementing the present invention, and peripheral features which may be disclosed herein, may be organized in a wide variety of fashions. However, utilizing the Texas Instruments 9900 family, and suitable interface modules for working there with, an elevator control system of the type illustrated in FIG. 1, with separate controllers for the cabs, the cars, and the group, has been implemented utilizing real time interrupts, power on causing a highest priority interrupt which provides system initialization (above and beyond initiation which may be required in any given function of one of the controllers). And, it has employed an executive program which responds to real time interrupts to perfrom internal program functions and which responds to communication-initiated interrupts from other controllers in order to process serial communications with the other controllers, through the control register unit function of the processor. The various routines are called in timed, interleaved fashion, some routines being called more frequently than others, in dependence upon the criticality or need for updating the function performed thereby. Specifically, there is no function relating to elevatoring which is not disclosed herein that is not known and easily implemented by those skilled in the elevator art in the light of the teachings herein, nor is there any processor function not disclosed herein which is incapable of implementations using techniques known to those skilled in the processing arts, in the light of the teachings herein.

The invention herein is not concerned with the character of any digital processing equipment, nor is it concerned with the programming of such processor equipment; the invention is disclosed in terms of an implementation which combines the hardware of an elevator system with suitably-programmed processors to perform elevator functions, which have never before been performed. The invention is not related to performing with microprocessors that which may have in the past been performed with traditional relay/switch circuitry nor with hard wired digital modules; the invention concerns new elevator functions, and the disclosure herein is simply illustrative of the best mode contemplated for carrying out the invention, but the invention may also be carried out with other combinations of hardware and software, or by hardware alone, if desired in any given implementation thereof.

Figure 2:
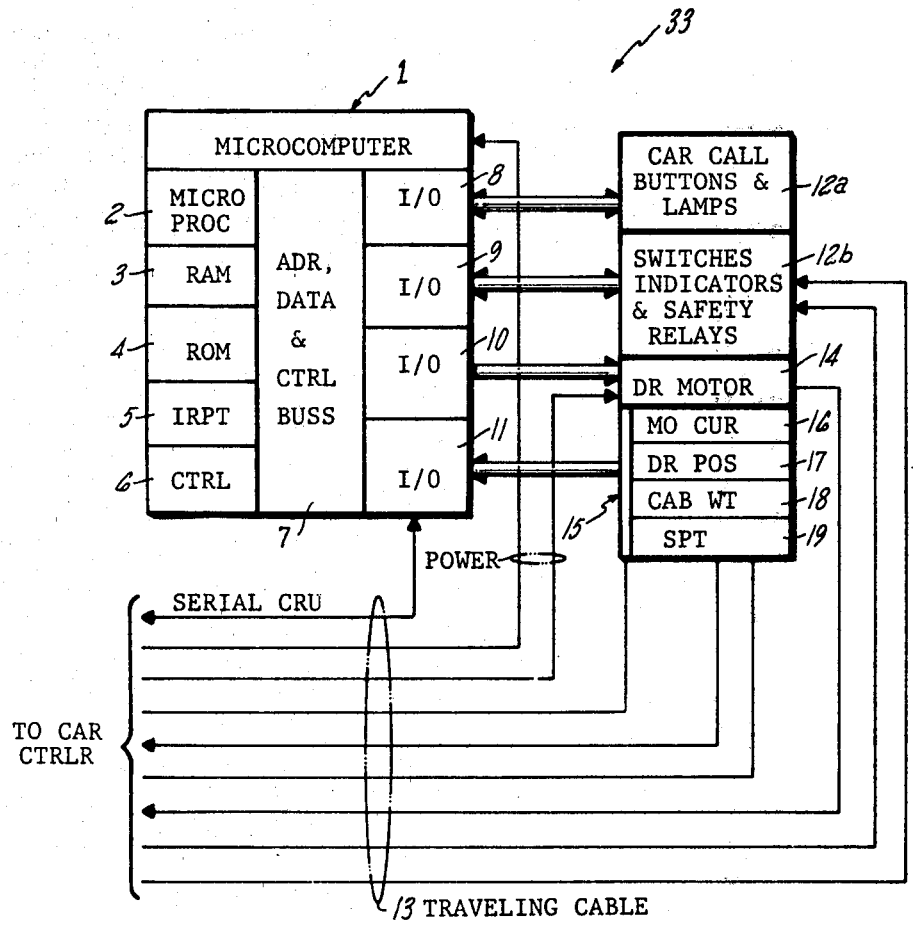
FIG. 2 is a simplified block diagram of a controller which may be utilized in the elevator system of FIG. 1.

Referring now to FIG. 2, a cab controller 33 is illustrated simply, in a very general block form. The cab controller is based on a microcomputer 1 which may take any one of a number of well-known forms. For instance, it may be built up of selected integrated circuit chips offered by a variety of manufacturers in related series of integrated circuit chips, such as the Texas Instruments 9900 Family. Such a microcomputer 1 may typically include a microprocessor (a central control and arithmetic and logic unit) 2, such as a TMS 9900 with a TIM 9904 clock, random access memory 3, read only memory 4, an interrupt priority and/or decode circuit 5, and control circuits, such as address/operation decodes and the like. The microcomputer 1 is generally formed by assemblage of chips 2–6 on a board, with suitable plated or other wiring so as to provide adequate address, data, and control busses 7, which interconnect the chips 2–6 with a plurality of input/output (I/O) modules of a suitable variety 8–11. The nature of the I/O modules 8–11 depends on the functions which they are to control. It also depends, in each case, on the types of interfacing circuitry which may be utilized outboard therefrom, in controlling or monitoring the elevator apparatus to which the I/O is connected. For instance, the I/Os 8, 9 being connected to car control buttons and lamps 12a and to switches and indicators 12b may simply comprise buffered input and buffered output, multiplexer and demultiplexer, and voltage and/or power conversion and/or isolation so as to be able to sense car call button closure and to drive lamps with a suitable power, whether the power is supplied by the I/O or externally. Similarly, the I/O 9 may be required to cause a floor warning gong or an emergency buzzer to sound, to light indicators indicative of elevator operating mode, and to sense switches (such as an emergency power switch, or key switches for express operation and the like), and to operate and monitor door motor safety relays.

On the other hand, the I/O 10 must either service an amplifier indicated as part of a door motor 14, or it must provide the amplification function. In such case, the I/O 10 may be specifically designed to be used as an I/O for a door motor 14; but if the door motor 14 includes its amplifier and monitoring circuitry, then a conventional data I/O 10 may be used. Similarly, an I/O 11 communicating with multi-functional circuitry 15, including door motor current feedback 16, a door position transducer 17, cab weight transducers 18, and a secondary position transducer 19 (which indicates the position of the car with respect to each floor landing) may be a general data I/O device if the functions are provided for in the circuitry 15, or it may be a specially-designed I/O device so as to perform necessary interfacing functions for the specific apparatus 16–19.

Communication between the cab controller 33 of FIG. 2 and a car controller (such as car controller 15 illustrated in FIG. 1) is by means of the well known traveling cable 13. However, because of the capability of the cab controller 33 and the car controller 15 to provide a serial data link between themselves, it is contemplated that serial, time division multiplexed communication, of the type which has been known in the art, will be used between the car and cab controllers. In such case, the serial communication between the cab controller 33 and the car controller 15 may be provided via the communication register unit function of the TMS-9900 microprocessor integrated circuit chip family, or equivalent. However, multiplexing to provide serial communications between the cab controller and the car controller could be provided in accordance with other teachings, known to the prior art, if desired.

The traveling cable also provides necessary power to the microcomputer 1 as well as to the door motor 14. For instance, ordinary 60 hz AC may be supplied to the microcomputer 1 so that its power supply can provide integrated circuit and transistor operating voltages to the various chips within the microcomputer 1, and separate DC, motor-operating power may be provided to the door motor 14. Other direct communications, such as between the secondary position transducer and the operation controller may be provided by hard-wiring in the traveling cable. Although not illustrated herein, additional wires for safety switches, power, and the like are also typically provided within the traveling cable. The desirability, however, of utilizing serial, time-division multiplex communications between the cab controller 33 and the car controller 15 is to reduce to two, the number of wires which may be necessary to handle as many as 200 discrete bits of information (such as car direction, request to open the door, car call registrations for particular floors, and the like). However, this forms no part of the present invention and is not described further herein.

Figure 3:
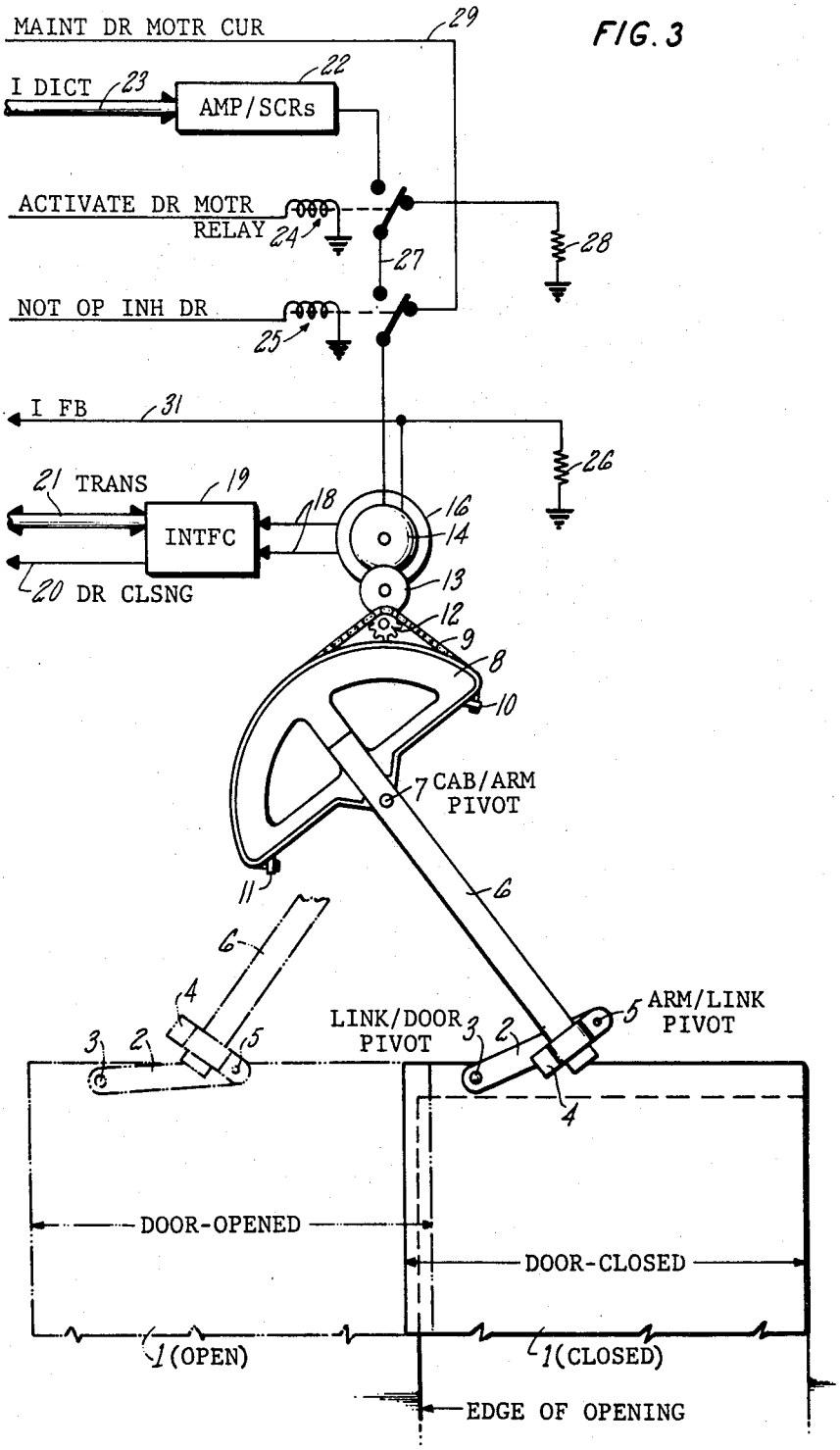
FIG. 3 is a simplified, broken away schematicized illustration of an elevator door operator for use with the present invention.

The door opening and closing controls described herein are capable of being utilized with virtually any type of elevator door which is desired. In order to understand the complexities of door operation more fully, a typical door operator is illustrated in FIG. 3. Therein, a door 1 is shown, partially broken away at the bottom, in solid lines in a fully closed position (to the right in FIG. 3), in heavy dashed lines in a fully open position (to the left in FIG. 3). The door is connected to a link 2 by a pivot 3 which in turn is connected to an arm slider member 4 by a pivot 5. The member 4 has an arm 6 passing there through such that the member 4 must revolve about a pivot 7 of the arm 6 as the arm revolves, but the member 4 may slide longitudinally along the arm 6, in a well-known fashion. The arm 6 is formed integrally with or connected to an arcuate member 8 to which there is connected a chain 9 affixed thereto at points 10, 11. The chain 9 engages a sprocket 12 which is driven through reduction gears 13 by a door motor 14. To open the door, as depicted in FIG. 3, the motor turns in the clockwise direction, causing the arcuate member 8 and the arm 6 to similarly rotate in the clockwise direction about the pivot 7. The arm therefore pulls on the link 4 driving it to the left or open position, which in turn drives the link 2 and therefore the door 1 through the pivot 3. As the door moves toward the open position, the link 2 rotates clockwise about the pivot 3, and the link 4 rotates clockwise about the pivot 5. At the end of travel, in the fully-open position, the links 2, 4, and the arm 6 have the position shown broken away at the left in FIG. 3.

The necessary consequence of the conversion of rotary motion to linear motion, as depicted in FIG. 3, is that the distance (as in centimeters) of the door motion per unit angle of revolution (as in degrees) of the motor 14 varies in dependence upon the actual door position. For instance, it is evident from FIG. 3 that the maximum door motion per increment of motor angle will occur when the door is midway between the open and close position, and will be somewhat less near the fully-opened or fully-closed positions. This variation in linkage is accommodated by means of a map or table of empirically determined values of incremental changes in door position for changes in motor position, as a function of door position.

When the arm 6 is vertical, its weight creates no force on the arm slider member; but when it is in any other position, the weight of the arm 6 affects door motion. During the first half (approximately) of travel, the arm aids motion (in either direction), but it impedes motion during the second half.

The actual door position may be monitored by a door position transducer 16 which is connected to the door motor shaft (or on the same shaft) or may be driven by the door motor in some other suitable fashion, such as a rack and pinion to provide a pair of phase related (direction indicating) bits over lines 18 to interface circuitry 19, which includes means to determine from the relative time of occurrence of the bits on the lines 18 whether the door is closing or opening, and thus provide the door closing flag signal on a line 20, and to sense the number of bits per cycle as an indication of door velocity and transmitting an indication thereof as the TRANS bits on lines 21. This circuitry may take the form of so much of the circuits described in the aforementioned Masel et al U.S. patent application as is necessary to acquire direction and count information from a single incremental encoder with quadrature output. The door position is derived by accumulating these bits elsewhere, followed by conversion from angles of rotation to actual door position.

Although not intended to be an accurate description of the manner in which the motor may be driven, FIG. 3 illustrates that a door amplifier circuit 22 may be provided with a digital value of dictated current on a bus of lines 23 to generate the desired current for the motor 14. The current is applied to the motor 14 only if a pair of safety relays 24, 25 are suitably activated, as described hereinafter with respect to FIG. 9. And a sensing resistor or the like 26 may provide a motor amplifier feedback current value on a line 31 to the cab controller 33. More specifically, the safety relay 24 is actuated by the door control routines when no faults or failures are detected by the self health subroutines. Actuating the relay 24 connects a circuit 27 with the amplifier 22. On the other hand, if the relay 27 is disenergized (as shown), it will connect the circuit 27 to a grounded resistor 28 which provides dynamic braking to the door motor, in the fashion long known in the art. The relay 25 is controlled by the operation controller, in the car controller, and is activated when the car controller determines that operation of the door should be left in the hands of the cab controller. But if the car controller senses that operation of the motor should absolutely be inhibited, or vetoed, then the relay 25 will be disenergized (as shown) so as to prevent the amplifier 22 from providing current to the motor 14. And, when in the disenergized state, the motor 14 is connected by means of a direct circuit 29 to the machine room to facilitate control of the motor by maintenance personnel directly from the machine room, such as to effect an emergency evacuation from an elevator cab. A specific condition that would cause the operation controller to disenergize the relay 25 is loss of motive power, with passengers in the elevator, and an inability to force the door open through normal logical control.

As illustrated in FIG. 3, a complete door control routine will consist of many subroutines to determine operating conditions, such as the position of the car with respect to a landing, commands to open and close the door, the health of various transducers, door reversal devices, and the like, to determine whether the door should be open, opening, closed, or closing, and if door motion is required, to determine whether it should be done at a slow final velocity, in accordance with a velocity profile that is position controlled, or if it should be accomplished with a principally time-controlled velocity profile. And, when the door is impeded or against its open or closed stops, the nature of stall current which should be dictated to the door motor. Various other features are performed in the enhancement of door motor operation, as is described more particularly hereinafter.

The door control routine may be entered from the executive program based upon real time interrupts decoded to the frequency that is required of the door control program, such as about every 16 milliseconds. The program is reached through an entry point 1, and the first subroutine therein 2 is referred to as autonomous mode, which provides for sensing a failure of communication between the cab controller and the car controller, inhibiting car motion near a landing, opening and closing the doors while turning the lights on and off and sounding a buzzer to frighten the passengers off the car, which is described more fully and claimed in a commonly owned copending U.S. patent application filed on even date herewith by Deric, Ser. No. 107801, now U.S. Pat. No. 4,308,935 (Otis Docket No. OT-376). In asafety check subroutine 3, various factors which can control the safe response to door motion commands are taken into account (such as the car being close to a landing) to permit commanded door operation only when safe, and to force safe door conditions when necessary. In an initiation subroutine 4, specific door initialization during a power on reset are made, and various conditions are established during normal operations at the start of each pass through the door control routine so as to control the functioning thereof.

In a door position/velocity subroutine 5, the door motion transducer increments are monitored and converted to linear door position and velocity factors, as well as providing a linkage ratio as a function of door position for use in door motor compensation and current calculations. In a door direction subroutine 6, commanded door direction and reversal requests are processed. A compensation subroutine 7 provides motor current compensation components to take into account the weight of the door actuator arm, friction, and the force of the hoistway door spirator or spring.

Determination of whether stall current should be dictated to the motor or a velocity profile should be dictated to the door motor is accommodated in a velocity/stall subroutine 8. Stall current is dictated to the door motor in a stall dictation subroutine 9, which stall is indicated by the subroutine 8, and motor current is outputted by a subroutine 9*a*. Otherwise, the factors for a position-controlled velocity profile may be selected, in a position-controlled profile select subroutine 10 or the factors for a time-controlled velocity profile may be selected in a time-controlled profile selection subroutine 11. These are factors such as the maximum acceleration and velocity, final velocity, and conditions for changing from one acceleration or rate of acceleration to another as the door is moved.

Selection of suitable acceleration and velocity factors is performed in a subroutine 12, a position-controlled velocity is dictated in a subroutine 13, and time-controlled velocity as well as the variance between actual and dictated velocity are provided in a subroutine. Actual current is calculated and modified in accordance with specific conditions in the dynamic compensation subroutine 15 and outputted in the subroutine 9*a*, which completes the door control program whenever it involves dictated velocity profiles.

Figure 4:
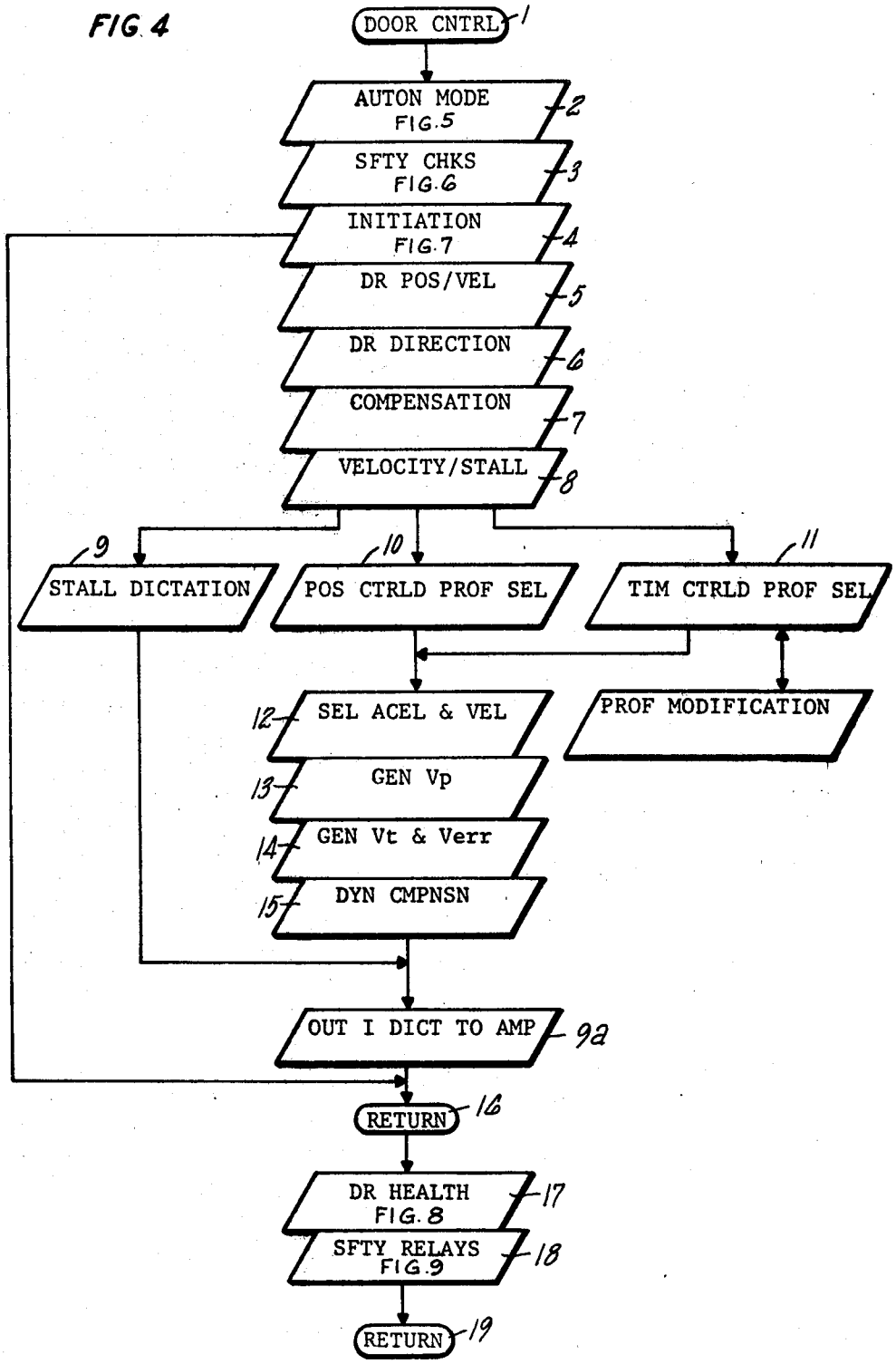
FIG. 4 is a logic flow diagram of the subroutines of a door control routine and door health and safety subroutines, which may be utilized in implementing the present invention and/or its environment.

The door control program of FIG. 4 may return to the executive through a transfer point 16, and then a door health routine 17, including a safety relay subroutine 18, monitors certain conditions indicative of the health of the door operation function, and sets and monitors safety relays that may absolutely inhibit the car motion or door motion in dependence upon the safety conditions of the subroutine 17 or in dependence upon conditions in the operation controller in accordance with the invention. Normally, the door health subroutine 17, 18 will be performed following the door control routine, in each case. Completion of all of the door control functions will cause return to the executive program through a transfer point 19.

All of the functions of the door control routine of FIG. 3 not described in detail hereinafter are described in a commonly owned copending U.S. patent application filed on even date herewith by Hmelovsky and Games, Ser. No. 107804, now U.S. Pat. No. 4,300,663.

The autonomous mode provides for emptying the car in the case the communications between the cab and its operational control (in the car controller, as described hereinbefore) have failed. This distinguishes from prior elevator systems in which the hard wiring provided in the traveling cable between the cab and the machine room associated with the shaftway was always assumed to be operative, and if the communications provided by that hard wiring failed, then a catastrophic failure of a stuck elevator was allowed to occur, the only solution being the intervention of maintenance personnel. But with the thought by some members of the public that the multiplexing of data between the cab and the car is less reliable than hard wires for each indicium of data which is required, an additional operational mode is provided through an entry point 1 indicated in FIG. 5. All data transfers between the car controller (15, 16 FIG. 1) and the cab controller (33, 34, FIG. 1) are checked in the cab controller, such as with common parity and longitudinal redundancy checks and handshakes. Any error causes the cab controller to generate a communication failure flag. In test 2, if communications are determined not to have failed, step 3 resets a door once flag to ensure that, once communications have been reestablished if they had failed, this flag is guaranteed to be in the reset state. And a step 3a resets the inhibition of car motion (as described below), to allow services to be restored in the event that communications are restored before the door is opened. Then, this subroutine is exited by means of the transfer point 4. But if step 2 indicates that there has been a communication failure, due to improper operation of the handshake communications and/or data checks described hereinbefore, then a test 5 determines whether the cab has been within the inner door zone (that is within about 7.5 cm of the floor) for more than 10 seconds. If it has, the car must have been ordered to stop by the car controller; a lesser time could be indicative of the car just passing by a floor, without stopping. If it has not, then it must be assumed that the car has not come to rest and, it is also assumed that the car could continue to have motion and approach a floor sufficiently to allow passengers to escape. For that reason, a step 6 resets an autonomous mode inhibit car motion flag, the lights are maintained on by setting an enable functional lighting flag in step 7, a buzzer command bit is reset in step 8, since there is no need to try to "chase" or "scare" the passengers out of the cab by sounding a buzzer, and the door is prevented from opening by ensuring that the door open demand is reset in step 9.

If the car is still moving toward a floor at which it is commanded to stop, eventually the cab will be within the inner door zone for 10 or more seconds. Thereafter, the purpose of the autonomous mode of operation is to cause the car to stop, to thereafter command its doors to be opened, to intimidate or scare the passengers out, by turning off the lights and sounding a buzzer, to re-enable the lighting and stop the buzzer, close and open the doors, and so forth, as is described more fully below. In such case, all subsequent passes through the autonomous mode subroutine when tests 2 and 5 indicate that there has been a communication failure and the car has been within the inner door zone for more than 10 seconds, will commence with a test 10 to determine if the door has been fully open once. This is accomplished because the door once flag of step 11 can be set only upon failing the test, which can occur only before that flag is set when the doors are fully open. And once that flag is set, it can only be reset by step 3, which can only be accomplished by removing the communication failure as indicated in step 2. Thus, so long as a communication failure continues, after the door once flag 11 is set the first time, test 10 will be negative, regardless of whether the door is fully open or not. Until the door once flag is set, the outcome of test 10 depends only upon whether the door is fully open or not, if the door is not fully open, the test will be affirmative. This causes the autonomous mode inhibiting the car motion in step 12, the functional lighting to be enabled (to keep the lights on in the car) in step 13, the buzzer command to remain reset in step 14, but the door is conditionally demanded to be open in step 16 by setting the door open demand bit. As a consequence of the door open demand being set, dependent upon other safety conditions which are described with respect to FIG. D2 hereinafter, eventually the door will be fully open if it can be. This will cause step 10 to fail so the door once flag will be set in step 11. And, on the first passage through step 11, a test 16 will necessarily be affirmative causing car motion to be inhibited in step 17 by setting the autonomous mode inhibit car motion bit, the lights in the car are turned off in step 18 by resetting the enable functional lighting bit, and the buzzer is caused to sound by setting the buzzer bit in step 19. This is designed to ensure that the car stays put (as described with respect to FIG. 9, hereinafter), and to frighten the passengers out of the car by having the lights go off and the buzzer on while the door is fully open (test 16). This will continue in subsequent passes until a test 20 determines that the door has been fully open for 10 seconds. And the door will remain fully open for 10 seconds since an affirmative result of test 20 is required in order for the open door command (indirectly generated by the door open demand of step 15) to be reset in step 21.

The closing command resulting from step 21 (FIG. 5) will ultimately cause the door to leave the fully open position so that test 16 will be negative. This causes a test 22 to determine if the doors have reached the fully closed position. During the period of time necessary to close the doors, each pass through the autonomous mode subroutine will reach test 22 and fail, causing car motion to remain inhibited by step 23 setting the autonomous mode inhibit car motion bit, keeping the lights on once the doors start to close by step 24 enabling the functional lighting, and causing the buzzer to be off by resetting the buzzer bit in step 25. Thus, after the doors have been open for 10 seconds and begin to close, the buzzer goes off and the lights go back on. Eventually, after the doors are fully closed, test 22 will be affirmative, and the car empty indication is interrogated in step 26. If the car is not determined to be empty, the door is indirectly commanded to be open by step 27 (which is similar to step 15) and will ultimately cause the doors to become open, so that test 16 will cause a repeat of steps 17–21. And, car calls are inhibited by resetting the enable new car calls bit in step 28. This prevents any passengers from deciding that they would like to use the elevator while it is in the autonomous mode due to a communication failure. Eventually, the logical conditions indicative of an empty car may become apparent so that step 26 will be affirmative. In that case, a test 29 is made to determine if the further assurance of emptiness has been established as indicated by the car really empty bit. If not, nothing further is done. Eventually, if the car is really empty (as determined by the load weight or elapsed time without any button activity, in the manner described fully and claimed in a commonly owned copending U.S. patent application filed on even date herwith by Bittar and Deric, Ser. No. 107,672, now U.S. Pat. No. 4,299,309, then the car is determined to be capable of waiting in a lights-off, door-closed, motion-enabled condition, and step 30 will reset the autonomous mode inhibit of car motion and step 31 will turn off the lights by resetting the enable functional lighting bit. In every subsequent passage through the autonomous mode subroutine as long as the communication failure continues, the path will be thorugh tests 5, 10, 16, 22, 26, and 29 to steps 30 and 31. In each passage through the autonomous mode, exit is made through the transfer point 4 in FIG. 5, to the safety check subroutine entry point 1 in FIG. 6. As is apparent in the description of FIG. 6 which follows, the autonomous mode is subject to the door openings and closings which are commanded as a consequence of the safety check subroutine.

In FIG. 6, the first test 2 determines whether the operational control (in the car controller) has sent down a force door open command. Such may be the case in circumstances such as to release trapped passengers when car motion has failed, which indicate that regardless of the door position, door speed or otherwise, the door should be forced open for the safety of the passengers. And, in some instances, this may be effected by maintenance personnel to test door openings and closings remotely. In any event, though, the door will not open when the car could be moving, since that could be dangerous.

If the door is to be forced open as indicated by test 2, step 3 will inhibit any further motion of the car by setting a safety inhibit car motion bit. And step 4 prevents the safety check subroutine from forcing the door closed by resetting the force door closed bit. Then, test 5 determines if car motion has been absolutely inhibited for more than eight seconds. This test is a hard-wire connection to a relay contact on a relay which is activated only in the absence of the car motion inhibit. When deactivated, test 5 can be affirmative, and the sheave motor is disconnected. If it has not, it cannot be assumed that the car motion has been stopped, so the safety circuits demand the door to be closed by resetting the safety door open demand in step 6, and door direction reversal is prevented by setting the safety nudge in step 7. But after car motion has been inhibited for eight seconds, test 5 will lead to step 8 which sets the safety door open demand bit (to ultimately command the door to open) and sets the safety nudge to equal the nudge condition that has been indicated by the operation controller, which could either be nudge or not nudge. A nudge prevents door reversal and causes a low force on the door. Thus, a force door open command from the operation controller, determined in test 2, will eventually result in the safety checks subroutine demanding the door be opened, but allowing the operation controller to permit door reversals, or not as it sees fit, since reversal would not be effected during opening.

If no force door open command has been sent down by the operation controller, test 2 will be negative and test 10 will determine whether the top of car switch (which is set by personnel to indicate that they are riding on top of the car) has been set and validated by an inspection key. If that is the case, or if the secondary transducer (which closely monitors the position of the car with respect to each floor landing) has indicated a failure in test 11, then steps 12–14 will allow the operation controller to determine whether a door open demand should be made, whether nudge should occur, and will prevent the safety circuits from forcing the door. But if there is no inspection or secondary transducer failure, then test 15 determines whether the car is in the outer door zone. If it is not within the outer door zone, step 16 demands that the door be closed, and door reversals are inhibited by setting the safety nudge in step 17. Inner door zone monitoring of door closure is prevented by resetting the force door closed flag in step 18, since it might have been set, as described hereinafter, and the car continued to move away from the floor. Thereafter, so long as the door remains fully closed, as indicated in test 19, step 20 will permit car motion to continue by ensuring reset of the safety inhibit car motion bit. As soon as the door is no longer fully closed, the subroutine will inhibit car motion by step 21 setting the safety inhibit car motion bit.

In any passage through the safety check subroutine of FIG. 6 where step 15 is reached and is affirmative, indicating that the car is now within the outer door zone, a test 22 will initially determine that the force door closed flag is not set (although it ultimately may become set). This is so because test 22 must be negative in order to reach the part of the subroutine where the force door closed flag can be set in the first place. Thus, step 22 must first fail before it can be affirmative. This failure causes test 23 to determine if the doors have not been fully closed while the car has remained outside of the inner door zone for a period of a second (e.g., is stopped). Or, test 24 can determine that the doors are not fully closed and the car's position has changed from being within the inner door zone to being outside of the inner door zone during the past two cycles (after which it could be ignored). In either of these cases, step 26 will cause car motion to be inhibited by setting the safety inhibit car motion bit, step 27 will cause the safety checks subroutine to demand that the door be closed, step 28 will cause the safety subroutine to prevent door reversals by setting the safety nudge bit, and step 29 sets the force door closed flag which indicates that inner door zone violations (tests 23 or 24) have caused a door closing demand by resetting of the safety open door demand in step 27. In subsequent passes through the safety checks subroutine, step 22 will be affirmative, and a step 30 will be negative until the doors become fully closed; but once the doors are fully closed, test 30 will be affirmative and a step 31 will remove the safety checks subroutine inhibition of car motion. To assure that contact bounce or switch noise does not cause test so to be affirmative in one pass, inadvertantly enabling car motion in step 31, when the door is not really closed, step **31*a* will inhibit car motion any time test 30 is negative. A test 32 is thereafter performed to determine whether the car has been within the inner door zone for one second: if not, then no action is taken by the safety checks, at least as a consequence of the initial failure of steps 23 and 24. But assuming that removal of the car motion inhibit in step 31 causes the car to move still further away from the floor, it could leave the outer door zone as determined in step 15. This would cause the force door closed flag to be reset in step 18, so that the condition of the door (being fully closed) would cause test 19 to simply continue the absence of inhibition on car motion as indicated in step 20. Then a subsequent determination in test 15 that finally an outer door zone has been reached as a consequence of motion could cause a failure of test 22 so the process could repeat itself as the car approached a subsequent floor. But assuming that the car did not travel to a different floor, the operation controller may ultimately force the door open in step 2. If the outer door zone is reached, as in normal cases, the safety check subroutine passes vertically downward through test 2, 10, 11, 15, 22, 23 and 24, and the only function performed is that of allowing the door open demand and the nudge to be controlled by the operation controller, by setting of the safety door open demand bit to equal that of the door open demand and the safety nudge bit to equal that of the nudge bit, in steps 36 and 37. And, step 38 ensures car motion is possible, even if changes in conditions had left the inhibit set in some prior pass through the subroutine. Regardless of the particular route or condition, all passes through the safety check subroutine result in transferring through a transfer point 39 on FIG. 6 to the initiation subroutine by means of entry point 1 on FIG. 7**.

Figure 7:
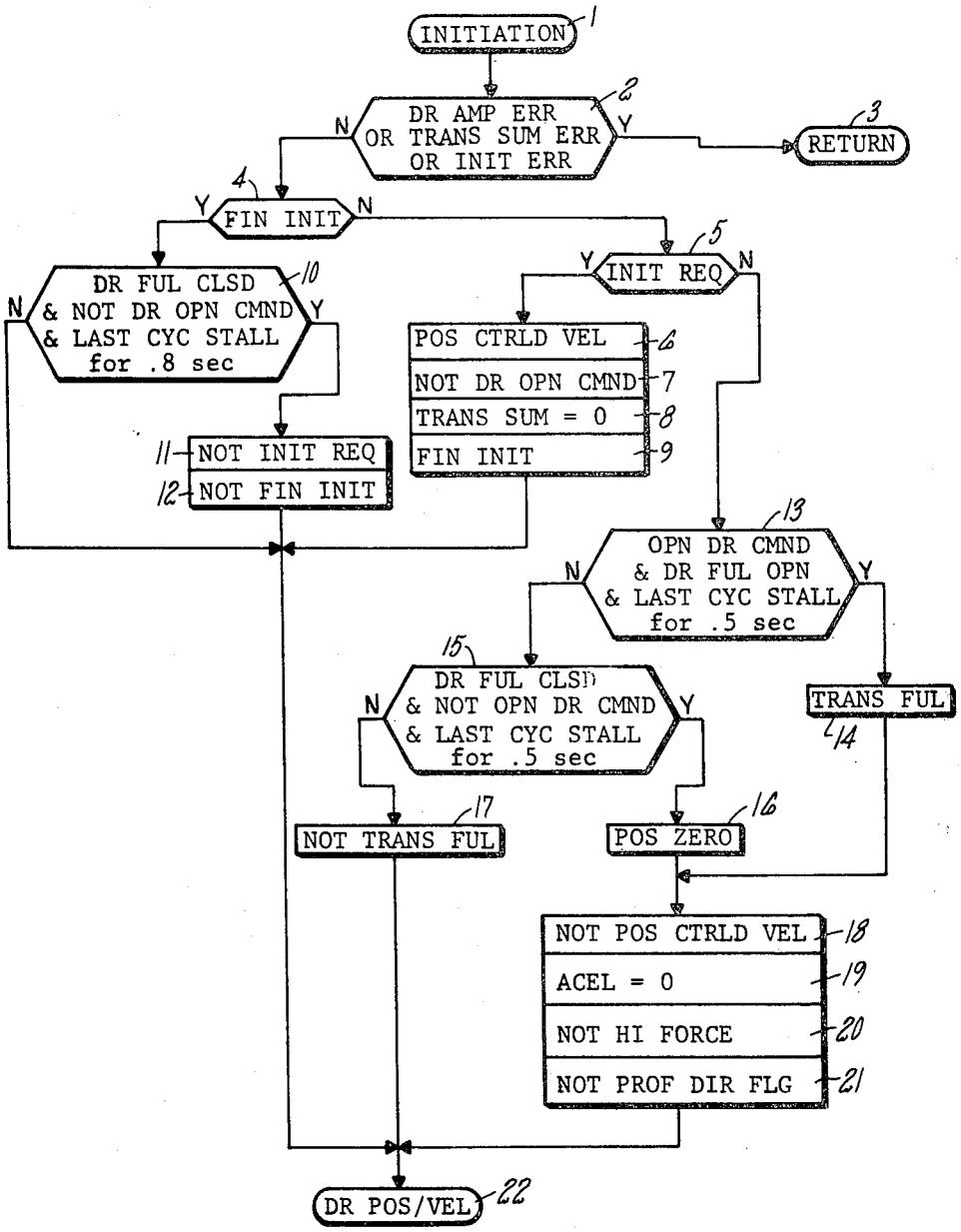
FIG. 7 is a logic flowchart of an initiation subroutine.

Referring now to FIG. 7, the door control routine and the initiation subroutine is entered through an entry point 1. In test 2, any one of three different errors relating to the door amplifier, the transducer sum or excessive initiation time will cause the door control routine to be bypassed through a return point 3. The indications of these errors are all generated in a door health subroutine described with respect to FIG. D16, hereinafter. But is this test fails, indicating that there is no error, a test 4 determines whether there is a partial initiation in progress. If not, a test 5 determines whether initiation is requested (which occurs during power up, as is described hereinbefore). It there is an initiation request, a step 6 establishes that a position-controlled velocity profile should be utilized, rather than a time-controlled velocity profile. Then, in a step 7, a command to close the doors is made, thus ensuring that the doors will remain closed if they are, or causing the direction to be toward closing if they are not fully closed at start-up. And, in step 8, the transducer sum (the accumulation of door position transducer bits) is set to zero, so that the position controlled velocity (step 6), in the closing direction (step 7) will be at the nearly-closed bench velocity (very slow, such as 4 cm/s, and therefore will be safe, regardless of original door position and/or transducer setting. With these tasks complete, that fact is indicated by setting a final initialization flag in step 9.

In the next pass through the subroutine of FIG. 7, test 4 will determine that the final initiation flag has been set, and will cause step 10 to determine if the door is fully closed, the command is to close the door, and the current dictation to the motor has been a stall dictation for the last 0.8 of a second. The door fully closed indication tested in step 10 is provided by a switch which can be activated to indicate door closure only within about a centimeter of full door closure. If these criteria have not been met, then this indicates that the door is not fully closed, and initiation cannot be deemed to be complete; therefore, in the next subsequent cycle, this same test 10 will be made once again, and so forth. Eventually, the door will be closed with a closure command and stall force will be dictated to the motor for 0.8 of a second. Thereafter, test 10 will be positive and this will be an indication of the end of door control initiation so that the initiation request flag is reset in step 11, and having finalized initiation, the final initiation flag is reset in step 12. On the next pass through the door control routine, step 2 will be negative, step 4 will be negative, and step 5 will be negative, reaching a normal (noninitiating) portion of the subroutine, which commences with test 13. If this test is affirmative, it indicates that the door is commanded to be open (and thus will stay open), it is fully open, and there has been stall current dictated to the door (maintaining the door open) for at least 0.5 seconds. Under this condition, it is known that the count in the transducer should be a maximum count. This is the count which is accumulated in a counter related to the door transducer as described with respect to FIG. 3 hereinbefore. Therefore, an affirmative result from test 13 will set a transducer full flag in step 14, which maybe utilized in the door health subroutine described hereinbefore with respect to FIG. 8 to determine if the maximum transducer count is reasonable. But if step 13 determines that the door is not fully open, test 15 will determine if the doors have been fully closed, without any command to open, and with dictated stall current for the past 0.5 seconds. If so, this guarantees that the door is fully closed and therefore at a zero position, which fact is registered by setting a position zero flag in step 16. But if tests 13 and 15 determine that the door is neither fully open nor fully closed, this fact is registered by step 17 resetting the transducer full flag (which will naturally occur after the doors have been fully opened but begin to close). In each non-initiating door control routine in which tests 13 or 15 are affirmative, step 18 resets the position-controlled velocity flag because the door may have been driven to the fully open or closed position by a position-controlled velocity profile as a result of reversal or blockage; but, now that the full open or closed position has been reached, the preferred time control profile should be used for the next door excursion. Step 19 ensures that the value of acceleration (an integrated value) to be used in dictating the door velocity begins at zero, each time a new door motion profile is generated after the door is fully open or closed. Step 20 resets a high force flag, because high force could have caused the door to become fully open or closed, but the subsequent motion of the door should be achieved with a normal profile, if possible. And step 21 resets a profile direction flag, which monitors direction change during a door velocity profile. In each pass through the initiation subroutine, the door control program advances through the door control program, FIG. 4.

Figure 8:
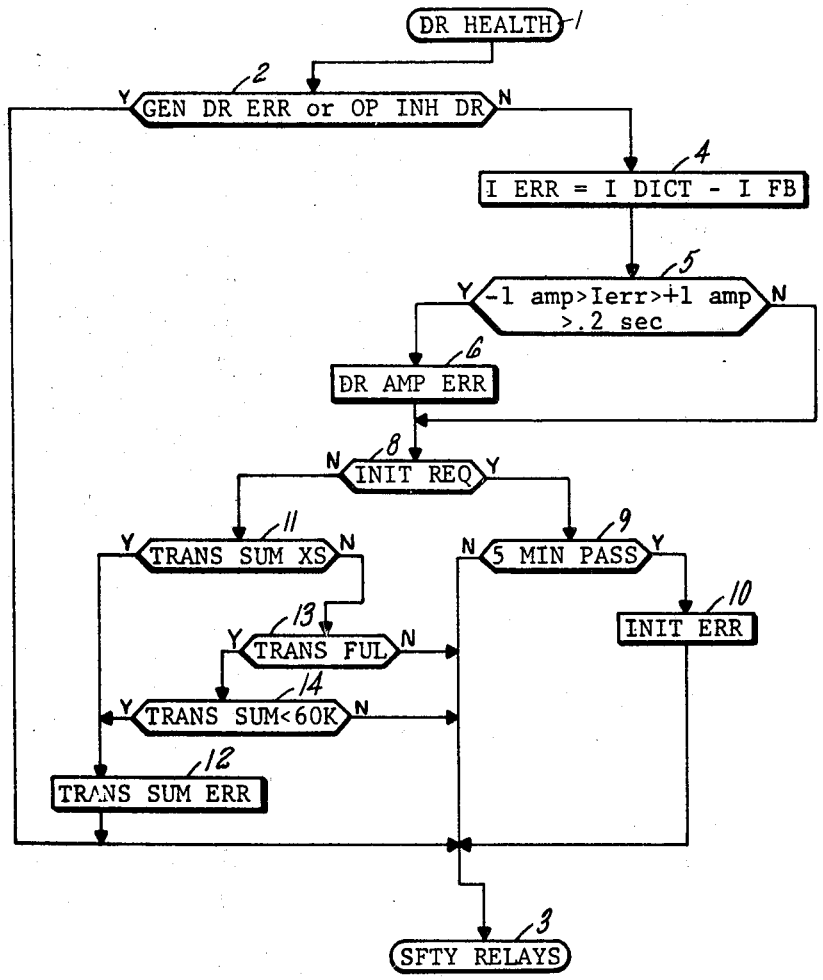
FIG. 8 is a logic flowchart of a door health subroutine.
Figure 9:
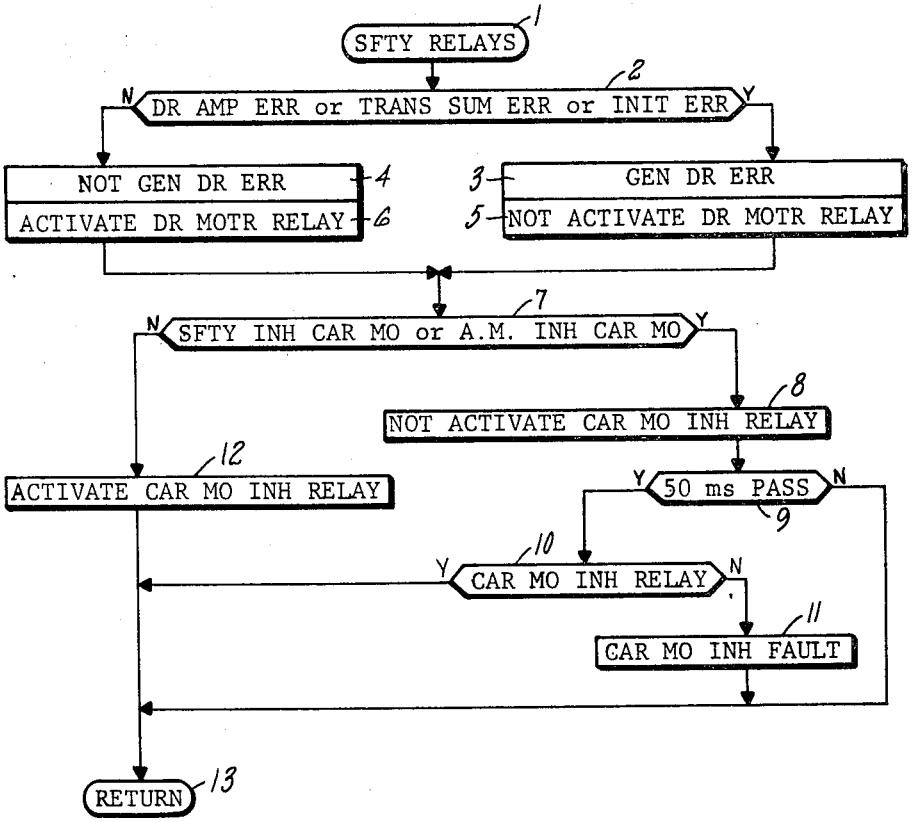
FIG. 9 is a logic flow chart of a safety relays subroutine.

Each time that the door control routine illustrated in FIG. 4 is run, regardless of whether it is an initiation cycle and returns directly as described with respect to FIG. 7, or a stall current is dictated or a full door profile (either position or velocity controlled) is dictated as described with respect to FIG. 4 the door health routine of FIGS. 8 and 9 will be performed, since these are called by the executive immediately after the door control routine. The door health routine of FIG. 8 is reached through an entry point 1 and a first test 2 determines whether the door health subroutine has found that there is a general door error (as is described below) or if the operation controller has inhibited door operation. If so, the door health routine will proceed directly through a transfer point 3 to the safety relay subroutine thereof, which is illustrated in FIG. 9. Otherwise, if test 2 is negative, a motor current feedback test is performed by first generating a current error as a function of the dictated current minus a feedback current which is fed back (FIG. 3) from the output of the motor amplifier to the cab controller, in step 4. Then, the current error is compared in test 5 to determine if it falls outside of the range between −1 amp and +1 amp for more than about 5 seconds. If it does, a step 6 sets a door amplifier error.

In FIG. 8, a test 8 checks to see if an initiation has been requested and a test 9 determines if this request has been outstanding for 5 minutes. If it has, a step 10 sets an initiation error, indicative of the fact that the door control routine cannot get initiated properly. This can occur for several reasons, but ultimately because the doors do not become fully closed, with a closing direction and in the stall condition for 0.8 second (test 10, FIG. 7). This could come about because of a faulty door motor, door blockage, or other factors.

If there is not an initiation request outstanding, test 8 of FIG. 8 will be negative and a transducer sum excess flag is checked in a test 11 to see if the transducer exceeds its maximum count, which may for instance be on the order of 71,000 counts. If it does exceed this count, a step 12 sets the transducer sum error flag. If it does not exceed the maximum count, then a test 13 determines whether the transducer full flag has been set (step 14, FIG. 7, indicating the doors are fully opened); if so, then a test is made to ensure that the transducer sum is within some range of maximum, such as having a count of at least 60,000 units. If the transducer sum is too low, the transducer sum error will be set in step 12. After determining whether the door amplifier error, initiation error and transducer sum error should be set, the door health routine proceeds to the safety relays subroutine by means of transfer point 3, and an entry point 1 on FIG. 9.

In FIG. 9, a test 2 determines whether any of the errors which may be set in FIG. 8 have been set. If so, the general door error flag is set in step 3. But if not, the general door error flag is reset in step 4. When the general door error flag 3 is set, it causes deactivation of a door motor relay in step 5. Commensurately, this relay can be activated in step 6 whenever the general door error is removed. The door motor relay is in series between the door motor power amplifier and the motor itself, as is a second relay, controlled by the operation control, the state of which is reflected by the operation inhibit door flag which is tested in test 2 of the door health routine in FIG. 8. Thus, the door motor may be completely deactivated by a relay controlled by the door health routine, or by a relay controlled by the operation controller.

As described briefly hereinbefore, the door control program, along with the safety relay subroutine of FIG. 9, can inhibit car motion in certain circumstances. If the safety inhibit car motion flag is set in steps 3, 21, 26, or 31*a* the safety check subroutine of FIG. 6, or if the autonomous mode inhibit car motion flag is set in steps 12, 17, or 23 of the autonomous mode subroutine in FIG. 5, this will be sensed in a test 7 which causes a step 8 to deactivate a car motion inhibit relay, which is a command to the operation control to have a specific relay operated that prevents car motion absolutely, such as a relay in series with the sheave-driving motor of the elevator. Once step 8 deactivates the car motion inhibit relay, a 50 milisecond time out is performed in test 9; if the operational control has not provided a signal back to the door program within 50 milliseconds after the door control program indication to the operation controller that the inhibit relay should be deactivated, test 10 will be negative and a car motion inhibit fault flag will be set in test 11. This fault is transmitted to the operation controller to indicate that it has demanded that car motion be inhibited and has not been advised that such is the case.

In the event that test 7 shows that the door control program has not commanded that the car motion be inhibited, a step 12 will ensure that the car motion inhibit relay is activated. Following step 11 or step 12, the door health program is completed and processing is returned to the executive program by means of a return point 13.

Figure 10:
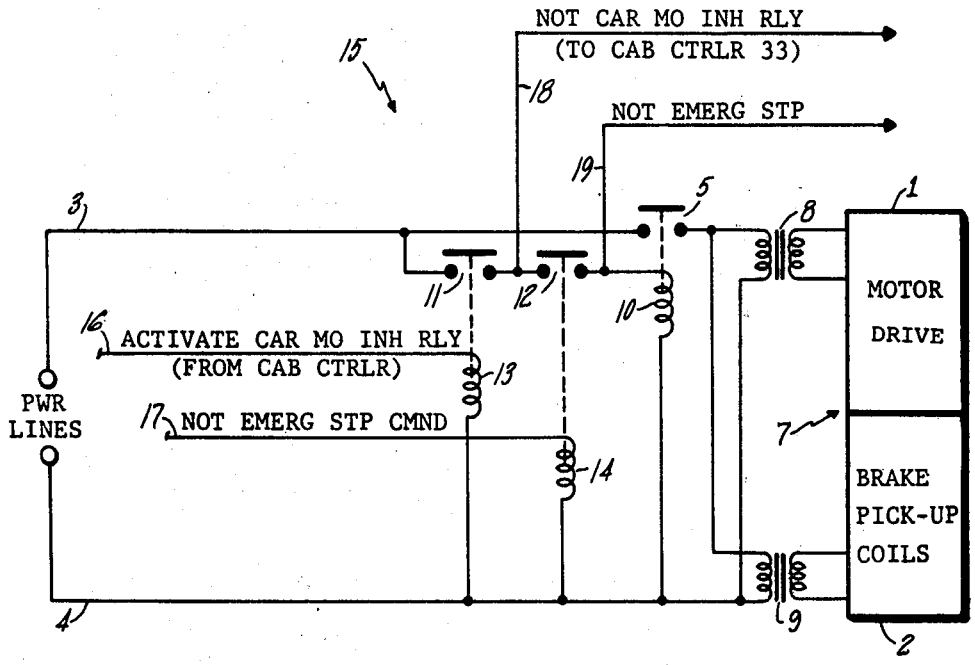
FIG. 10 is a simplified schematic diagram of car motion inhibit means.

Referring now to FIG. 10, a portion of the car controller 15 (FIG. 1 and FIG. 10) is illustrated as including means for controlling the application of power to the motor field 1 and brake pick-up coils 2 of the sheave/-motor/brake assembly 7 (FIG. 1 and FIG. 10). Specifically, operating power is provided from a pair of power lines 3, 4 to a normally-open main relay contact 5 to a pair of transformers 8, 9 which provide power to the motor field 1 and the brake pick-up coils 2. The motion of the car is totally inhibited and arrested whenever the relay contact 5 is open because the motor will have no field excitation and the spring-loaded brakes (typical in most elevator installations) will be operable because the pick-up coils 2 will have no power applied thereto.

In FIG. 10, the relay contact 5 is normally open and is closed when a related relay coil 10 is energized by power applied from the line 3 through additional normally-open relay contacts 11, 12. The relay contacts 11 and 12 are in turn closed when power is applied to related coils 13, 14 by signals applied on corresponding lines 16, 17. The signal on the line 17, which has nothing to do with the present invention, is normally generated whenever there is not an emergency stop command indicated by failure of a variety of safety checks in the car controller (15, FIG. 1), of the type which is well known in the art. On the other hand, the signal on the line 16 is generated in response to the presence of a similarly named flag bit, activate car motion inhibit relay, which is generated in step 12 of FIG. 9 in the event that the autonomous mode has sensed the communication failure, determined the car to be in the inner door zone for a requisite period of time, and set the A.M. inhibit car motion flag in step 12 or step 23 of FIG. 5, or in the event that the safety checks (FIG. 6) determine that the door is to be forced open (step 3), the door is not closed when outside the outer door zone (step 21), or the door is not closed when stopped in or drifting out of the inner door zone (steps 26 and 31*a*), which are both tested in test 7 of FIG. 9, as described hereinbefore. When car motion is to be inhibited, test 7 of FIG. 9 will be affirmative and step 8 will reset the activate car motion inhibit relay, so no signal will appear on line 16 of FIG. 10. In such a case, the relay contact 11 will become open, causing the relay coil 10 to be disenergized, so that the main contact 5 will open, assuring that motion of the car is arrested.

When the contact 11 is open, there is no signal on a line 18 which is connected to the cab controller 33 (FIG. 1) and which provides the basis for the logical bit to be tested in test 10 of FIG. 9 and test 5 of FIG. 6, as described hereinbefore. A similar feedback or monitor line 19 may provide information to the car controller indicating an emergency stop event (whether caused by the lack of an activate car motion inhibit relay signal on the line 15, or otherwise. This signal is used in test 14 of FIG. 11 to allow the door motor to work, as is described with respect to FIG. 11 hereinafter.

Figure 11:
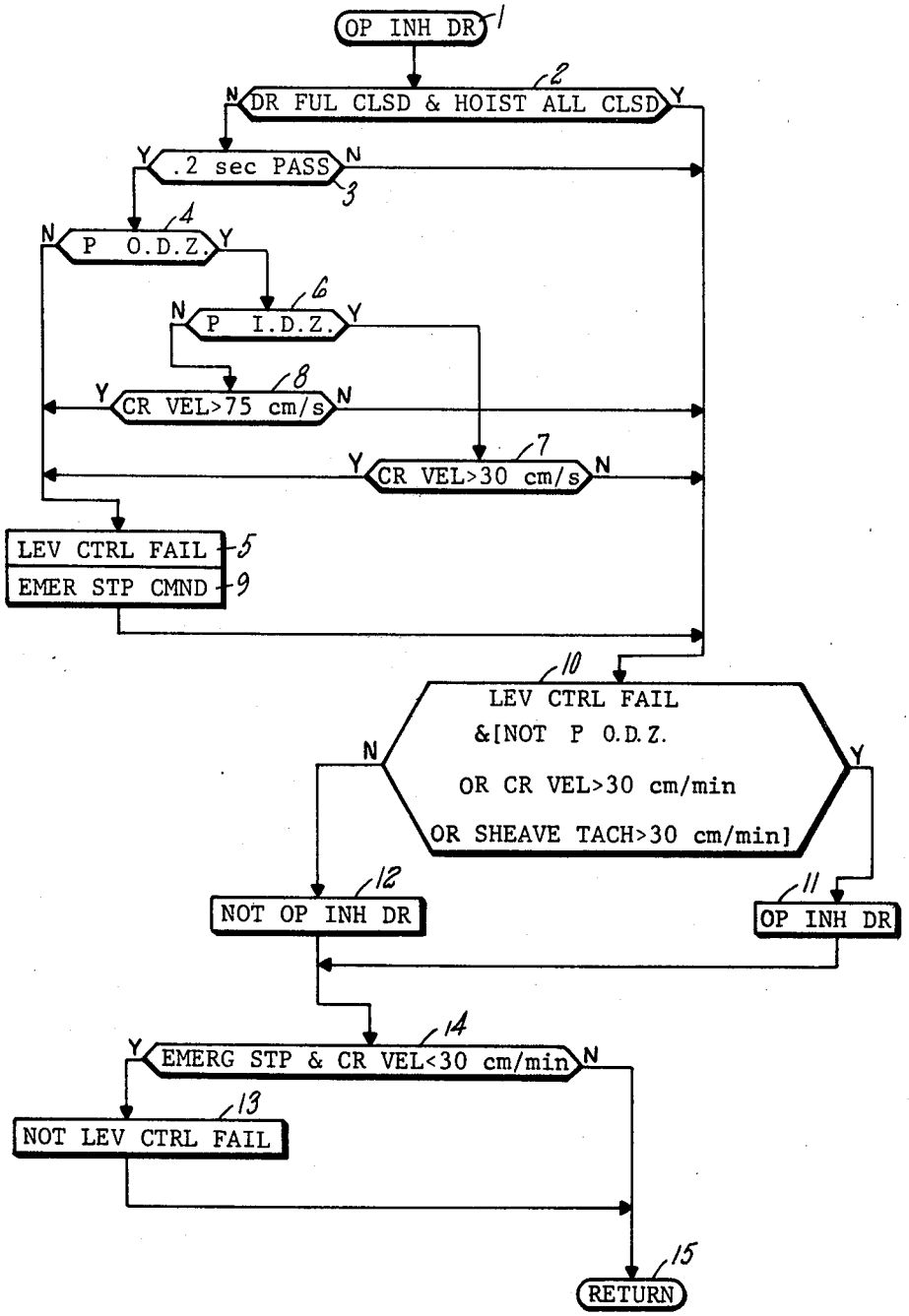
FIG. 11 is a logic flowchart of an operation controller inhibit of door motion subroutine.

Referring now to FIG. 11, an exemplary, simplified logic flowchart for functioning of the car controller 15 (FIG. 1), in providing the cross-coupled interlocks of the present invention, is entered through an entry point 1, either in response to program structure or operation of the executive program, as suits any implementation of the present invention. In FIG. 11, a test 2 determines if the elevator door is fully closed and all of the hoistway doors are closed. If they are, there can be no level control failure, so the next few tests and steps are bypassed. But if test 2 is negative, then a test 3 determines if test 2 has been negative for some period of time, such as 0.2 seconds. Until it has, the fact that test 2 is negative is not acted upon, since elevator door and hoistway door switches may bounce, and the signals indicative of their closed condition can have periods of noise thereon. But once test 3 is affirmative, indicating that the elevator door or a hoistway door is truly not closed, then a test 4 determines if the car is within the outer door zone of a floor landing, as determined (P O.D.Z.) from car position indicated by the primary position transducer 25 (FIG. 1). Normally, the car is within the outer door zone whenever the floor of the car is within about 23 centimeters (either above or below) the floor landing. If test 4 is negative, the car is too far from the floor to have any door openings at all, and a level control failure flag is set in a step 5. But if the car is within the outer door zone, test 4 will be affirmative and test 6 will determine (from the primary position transducer 25) whether the car is within an inner door zone, which occurs typically when the floor of the car is within about 7.5 centimeters of the landing floor. If it is in the inner door zone, then the velocity of the car should not be any greater than about 30 centimeters per second, as determined in test 7. But if the velocity is excessive, then the level control failure flag will be set in step 5. If not, that step is bypassed. Similarly, if test 6 indicates that the car is not yet within the inner door zone (after test 4 determines that it is within the outer door zone), then a test 8 will determine if the car is traveling faster than about 75 centimeters per second. If it is, the level control failure flag will be set in step 5; but if it is not, that step is bypassed. In a typical installation, the setting of a level control failure 5 may be one of the indicators for commanding an emergency stop, which may be done in a step 9 in the simplified embodiment herein.

In FIG. 11, whether or not the level control failure flag has been set in step 5, a test 20 determines if the flag has been set and either the car is outside of the outer door zone or there is an indication that is traveling at greater than a trivial speed, such as about 30 centimeters per minute, as indicated either by car velocity or a sheave tachometer, in dependence upon any implementation of the present invention. The car velocity, for instance, may be determined from the change in the incremental count of the primary position transducer 25 (FIG. 1) in a manner set fourth in the aforementioned Masel et al application, if desired, or in some other fashion. Thus test 10 will be affirmative if the level control failure flag was set as a consequence of the car being outside of the outer door zone, or if set when inside the outer door zone in the event that the car has any significant motion. An affirmative result from test 10 will cause setting of the operation inhibit door flag in step 11, which the car controller 15 then converts into the absence of the not operation inihibit door signal that is applied directly by the traveling cable to the relay coil 25 in FIG. 3, as described hereinbefore. Thus an affirmative result of test 10 in FIG. 11 will cause the relay 25 in FIG. 3 to open, thereby inhibiting the door controller from further control over the door motor 14 (FIG. 3). In such a case, if passengers were trapped in the car, maintenance personnel could drive the door motor by a signal on the line 23 (FIG. 3) as described hereinbefore.

In FIG. 11, if test 10 is negative, then the OP inhibit door flag is reset by a step 12, thus causing the car controller 15 (FIG. 1) to provide the signal over the traveling cable 13 (FIG. 1) to operate the relay 25 (FIG. 3) so that the cab controller can control the door motion. If desired, the inhibiting of door motion as a consequence of events sensed in the car controller can be released by a step 13 which will reset the level control failure flag (set in step 5 of FIG. 11) during emergency stop (set in step 9 of FIG. 11) whenever the car motion reaches a trivial amount, such as 30 centimeters per minute, as indicated by an affirmative result of a test 14. Thus when an emergency stop is caused by leveling problems, which require that door control by the cab controller by absolutely vetoed, as soon as the car slows down to an extremely low level, the doors may be returned to an openable condition by step 13. The programs which may be performed by a car controller may then be returned to through a transfer point 15.

The present invention is concerned specifically with the fact that the car controller and the cab controller are respectively provided with veto power over the respective motion functions of the opposite controller. Thus, as is apparent from the foregoing description, car motion can be inhibited as described with respect to FIG. 10 whenever the safety relay subroutine of FIG. 9 indicates that either the communication failure described with respect to FIG. 5 or the safety checks described with respect to FIG. 6 indicate that car motion should be inhibited. And similarly, the events described with respect to FIG. 11 can veto operation of the door motor as described with respect to FIG. 3.

Figure 5:
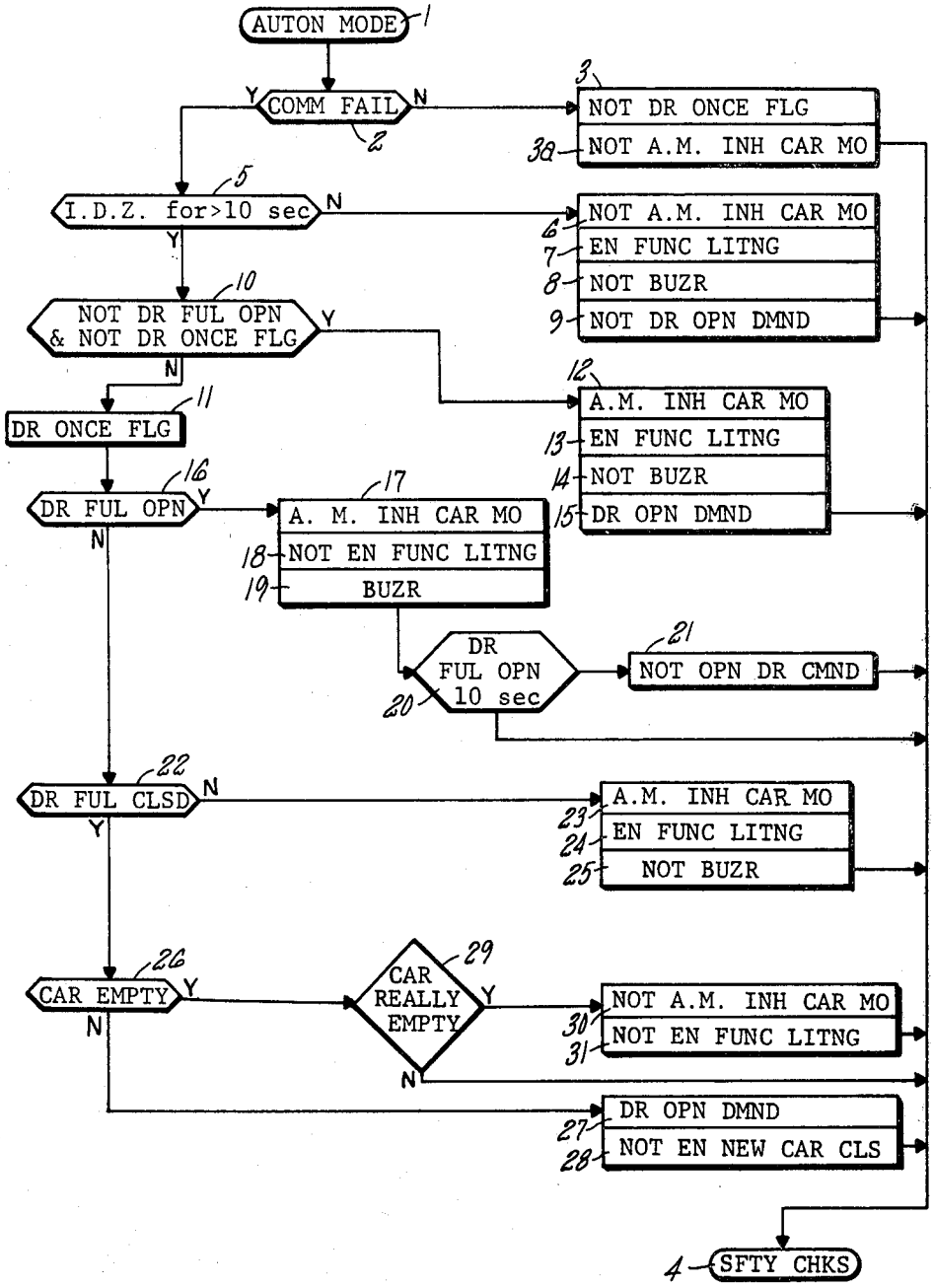
FIG. 5 is a logic flowchart of an autonomous mode subroutine.

The particular nature of the autonomous mode described with respect to FIG. 5, or the safety checks described with respect to FIG. 6 can be altered considerably, and still provide the car motion inhibit function which is tested in FIG. 9 and acted upon in FIG. 10. Similarly, the particular nature of the car controller functions illustrated in FIG. 11 can be altered in a variety of ways while still providing an inhibiting effect on the door motor as described with respect to FIG. 3. The times, speeds and other factors are of course highly variable, and will normally vary in dependence upon the particular design requirements of any given installation, or the code requirements in the jurisdiction of the installation. All of these are totally irrelevant to the present invention.

Similarly, although the invention has been shown and described with respect to an exemplary embodiment thereof, it should be understood by those skilled in the art that the foregoing and various other changes, omissions and additions may be made thereto and therein, without departing from the spirit and the scope of the invention.

We claim:

1. An elevator for servicing a plurality of floor landings, served by doors, adjacent an elevator hoistway in a building, comprising:

hall call means for registering requests for up or down service at each of said landings;

a car movably disposed in said hoistway;

car motion means for providing and arresting the motion of said car;

car controller means for providing signals indicative of conditions of said car, of said car motion means and of the hoistway doors, for exchanging signals with said car, for controlling said car motion means to cause said car to move in a selected up or down direction in said hoistway and to stop in response to said signals indicative of conditions of said car and of said car motion means and to signals received from said car and said hall call means;

said car including a door for providing access to and from said car, a door motion means for opening and closing said door, switch means for registering calls for service by passengers in said car, and a cab controller means for providing cab signals indicative of calls for service registered by said switch means and safety-related functions including the position of said car relative to an adjacent floor landing and the open or closed status of said door, for exchanging signals including said cab signals with said car controller, and for controlling said door motion means in response to said cab signals and in response to signals received from said car controller; characterized by said car controller including car motion inhibit means operative in either of two states for enabling said car motion means to move said car when in a first one of said states and for forcing said car motion means to arrest the motion of said car when in the second one of said states;

said car including door inhibit means operative in either of two states for enabling said cab controller to control said door motion means to move said door when in a first one of said states and for forcing said door motion means to be unresponsive to said cab controller when in the second one of said states;

said cab controller means comprising signal processing means for providing a car motion inhibit signal in response to said cab signals indicative of said safety-related functions indicating an unsafe condition of said car, and for setting said car motion inhibit means into said second state in response to said car motion inhibit signal; and said car controller means comprising signal processing means for providing, in response to said signals indicative of conditions, an inhibit door signal indicative of one of said hoistway doors being open concurrently with said car not being within a permissible distance of any of said door landings or concurrently with said car having a velocity in excess of a permissible velocity, and for setting said door inhibit means into said second state in response to said inhibit door signal.

2. An elevator according to claim 1 further characterized by said cab controller signal processing means comprising means for providing said car motion inhibit signal in response to said cab signals indicating that said door is not closed and said car is at an impermissible distance from any of said landings.

3. An elevator according to claim 1 further characterized by said car controller signal processing means comprising means for providing, in response to said cab signals provided to said car controller by said cab controller and said signals indicative of conditions, said inhibit door signal indicative of one of said hoistway doors or said car door being open concurrently with said car having a velocity in excess of a permissible velocity or concurrently with said car not being within a permissible distance of any of said door landings.

4. An elevator according to any of claims 1 through 3 further characterized by said car including means for determining that the floor of said car is within a given distance of one of said landings and providing a door zone signal indicative thereof; and said cab controller signal processing means comprising means for providing a communication failure signal indicative of a failure in exchanging signals between said cab controller and said car controller, and for additionally providing said car motion inhibit signal in response to the presence of said door zone signal for a time interval indicative of negligible motion of said car within said given distance of said landing concurrently with said failure signal.

* * * * *